US005695674A

United States Patent [19]

Szadkowski

[11] Patent Number: 5,695,674

[45] Date of Patent: Dec. 9, 1997

[54] CASTING FLOW CONTROL DEVICE

[75] Inventor: Stanislav Szadkowski, Marly, Switzerland

[73] Assignee: International Industrial Engineering, S.A., Belgium

[21] Appl. No.: 343,586

[22] PCT Filed: May 27, 1993

[86] PCT No.: PCT/BE93/00029

§ 371 Date: Jan. 18, 1995

§ 102(e) Date: Jan. 18, 1995

[87] PCT Pub. No.: WO93/25334

PCT Pub. Date: Dec. 23, 1993

[30] Foreign Application Priority Data

Jun. 16, 1992 [BE] Belgium ..... 99200555

[51] Int. Cl.[6] ..... B22D 41/22

[52] U.S. Cl. ..... 222/600; 222/597

[58] Field of Search ..... 222/597, 600, 222/594; 266/236, 45

[56] References Cited

U.S. PATENT DOCUMENTS

| | | | |
|---|---|---|---|
| 3,760,993 | 9/1973 | Meier | 222/600 |
| 4,063,668 | 12/1977 | Shapland et al. | 222/600 |
| 4,687,186 | 8/1987 | Francois-Noël | 266/287 |
| 4,848,604 | 7/1989 | Fricker | 222/600 |
| 4,921,148 | 5/1990 | Muller | 222/597 |
| 5,141,139 | 8/1992 | Kleeblatt | 222/600 |
| 5,400,930 | 3/1995 | Richard | 222/600 |

FOREIGN PATENT DOCUMENTS

| | | |
|---|---|---|
| 896223 | 9/1983 | Belgium . |
| 0 202 213 | 11/1986 | European Pat. Off. . |
| 2 462 952 | 2/1981 | France . |
| WO 88/01211 | 2/1988 | WIPO . |

*Primary Examiner*—Scott Kastler

*Attorney, Agent, or Firm*—Seidel, Gonda, Lavorgna & Monaco, P.C.

[57] ABSTRACT

The device for controlling a pour rate according to the invention, which comprises a stationary upper plate (8), a movable plate (10) carried by a carriage (9) and a pouring tube (2). Control of the rate takes place by gliding the movable plate (10) against the upper plate (8), the pouring tube (2) being immobilized against the movable plate (10), just beneath the pouring orifice (27) of the movable plate (10) which blocks the tap hole (15). The immobilization of the pouring tube (2) with respect to the movable plate (10) is obtained by means (31) for pushing upwards which are secured to the carriage (9).

10 Claims, 3 Drawing Sheets

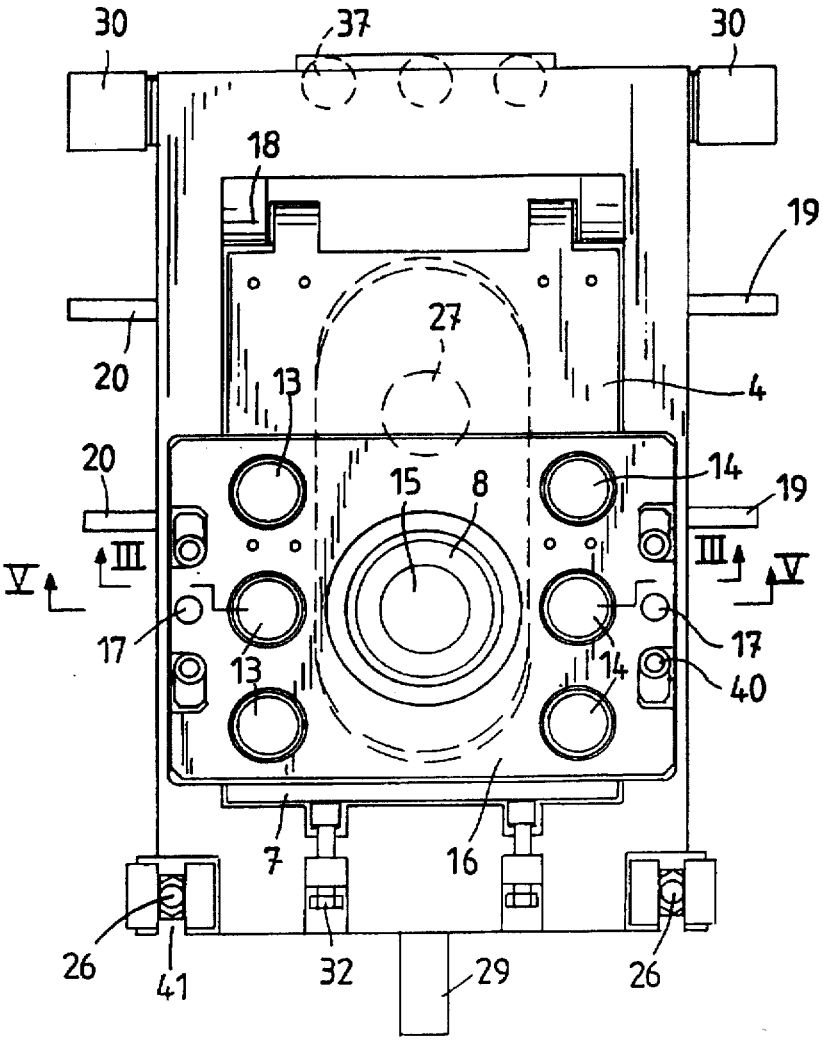
FIG. 2
FIG. 5
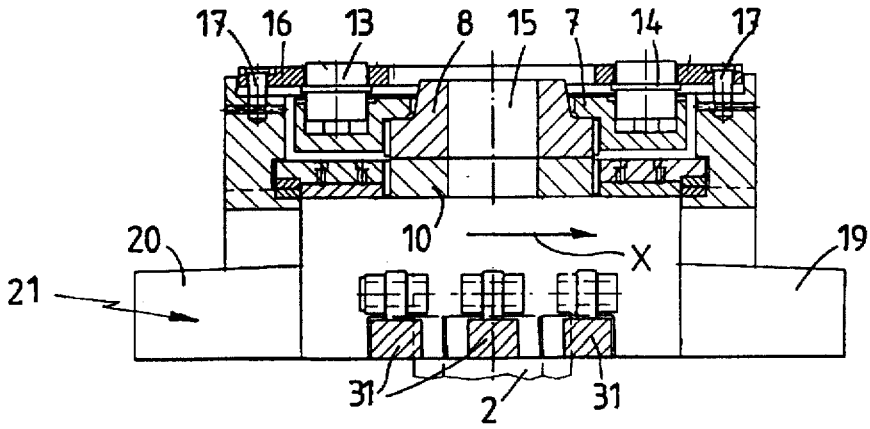

CASTING FLOW CONTROL DEVICE

BACKGROUND OF THE INVENTION

1. Field of the Invention

The present invention relates to a device for controlling a pour rate, the device comprising a rectangular metal chassis arranged so as to be able to pivot with respect to a bottom wall of the pouring ladle and a push-cover containing a stationary upper plate and a carriage carrying a movable plate which is compressed between the stationary upper plate and a flange of a pouring tube.

2. Description of the Prior Art

Document EP-A-0,202,213 discloses a metal chassis for a sliding closure device of a metallurgical container for continuous casting mainly including a base plate integral with the metal container and a pivoting swing door hinged onto the base plate.

In this document, the renewal of wear elements is greatly facilitated by the use of sliding closures fitted with one or more hinged doors.

The removable rotation hinges and the removable device for locking the door on the base plate allow easy access to the wear components, at the very point at which the steel is poured. A pressure-taking device is provided so as to apply the movable plate against the stationary plate whilst the pouring tube is held movably against the movable plate.

One drawback of this known device lies in the fact that the movable plate is held tightly between two stationary elements. Such a movable plate consequently has two gliding surfaces, the first face sliding with respect to the upper plate of the pouring tube.

SUMMARY OF THE INVENTION

The present invention aims to reduce the number of wear elements in gliding contact during control of the rate and also aims to improve the bringing and the exchange of a pouring tube under a pouring ladle or under a pour dispatcher without having to considerably modify the speed of extraction of the slab, bloom or billet.

To this end, the present invention proposes a hinged chassis for a device for controlling a pour rate making it possible to bring and to exchange a pouring tube such as described in the first paragraph of the descriptive text.

The present invention resides in a device for controlling a pour rate, including a rectangular metal chassis arranged so as to be able to pivot with respect to a bottom wall of a pouring ladle and a push-cover containing a stationary upper plate and a carriage carrying a movable plate which is compressed between the stationary upper plate and a flange of a pouring tube. The movable plate being capable of being moved from a position for blocking the tap hole to a position for opening it and vice versa. The carriage includes means for guiding the pouring tube in a horizontal plane and in a vertical position from a loading position to a standby position beneath the pouring office of the movable plate and from the standby position to a position for unloading the pouring tube and means for pushing upwards which fixedly apply the pouring tube against the pouring orifice of the movable plate in the position for blocking the tap hole and a device for pressing the upper plate against the movable plate.

The hinged chassis is essentially characterised in that the carriage includes means for guiding the pouring tube in a horizontal plane and in a vertical position from a loading position to a standby position beneath the pouring orifice of the movable plate, means for pushing the pouring tube upwards under the pouring orifice of the movable plate in the position for blocking the cap hole and a device for pressing the upper plate against the movable plate.

According to one feature of the invention, the push-cover is hinged onto the metal chassis around second pivots.

In one specific embodiment, the device for pressing the stationary upper plate against the movable plate consists of two series of spring cartridges arranged on either side of the tap hole along opposite sides of the stationary upper plate.

So as to prevent them from falling when the swing door opens, the spring cartridges are kept in place by a compression plate fixed removably to the push-cover with the aid of studs.

The original nature of the device for bringing and for exchanging the pour tube according to the invention lies in the fact that changing the tube takes place by gliding against the lower face of a movable plate forming a two-plate slide valve closure system, without, however, forming a three-plate system as described particularly in Belgian Patent No. 896,223.

The device according to the invention offers the advantage of making it possible to control the steel flow rate by translation of a movable part of the sliding closure device without the actual tube-changing device moving under the movable plate. Any damage to the seal between the movable plate and pouring tube, due to friction or infiltration of steel is thus prevented.

The pneumatic or hydraulic actuator or actuators which exert the forces necessary for the movement of the pouring tube for the purpose of changing the tube may be fixed directly:

- either to a stationary part of the machine;
- or to the movable carriage of the machine;
- or to an external manipulator, which does not form an integral part of the machine.

The movement of the pouring tube with a crossed motion, that is to say along two mutually perpendicular directions, offers the advantage of allowing first rapid and large-amplitude but inaccurate drive means to be implemented for bringing the pouring tubes to the immediate vicinity of the tap hole and second, small-amplitude, but very accurate drive means, perpendicular to the first ones, to be implemented for controlling the rate.

This mounting method not only allows the bringing and exchange of a pouring tube, but also allows the easy replacement of the wear components such as the stationary upper plate as well as visual examination of the internal nozzle.

BRIEF DESCRIPTION OF THE DRAWINGS

These features and other features and details of the invention will emerge from the following description of the appended diagrammatic drawings which represent, by way of illustration, one embodiment of the invention.

In these drawings:

FIG. 2 is a plan view of the device shown in FIG. 1;

FIG. 5 is a transverse section along the line V—V of the device illustrated in FIGS. 1 to 4.

In these figures, the same reference signs denote identical or analogous elements.

DESCRIPTION OF THE PREFERRED EMBODIMENTS

Figure 1:
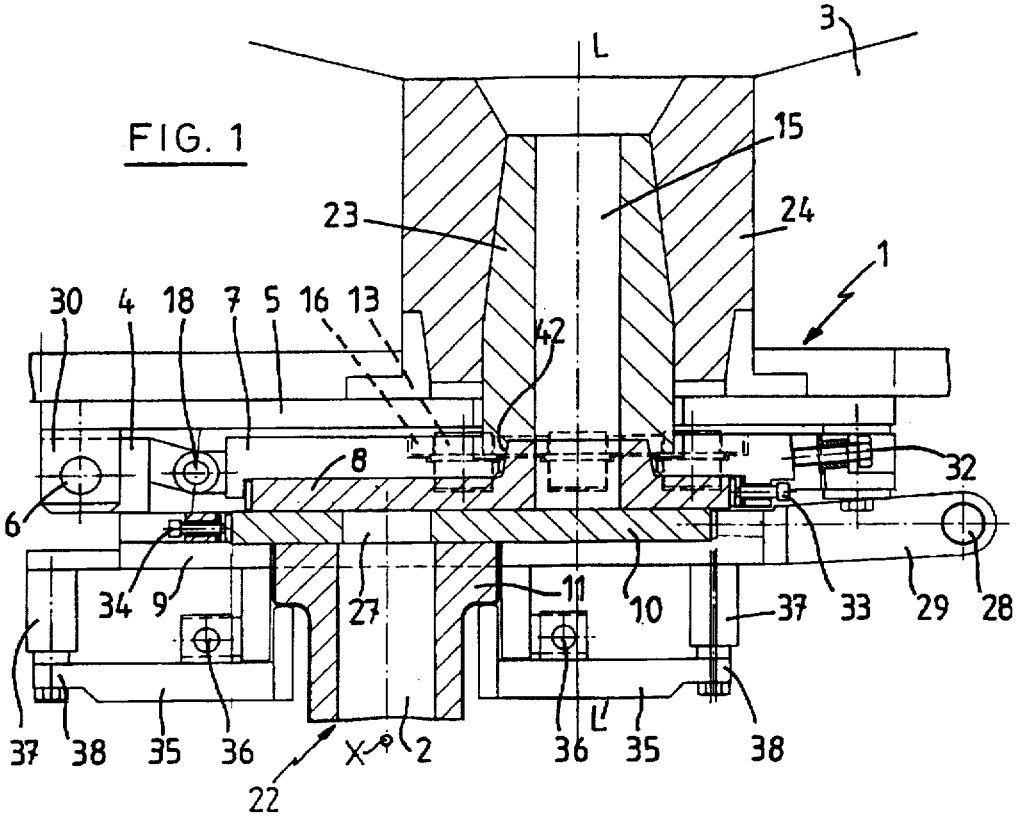
FIG. 1 is a longitudinal section of a device for bringing and exchanging a pouring tube and for controlling the rate, locked in the service position.
Figure 3:
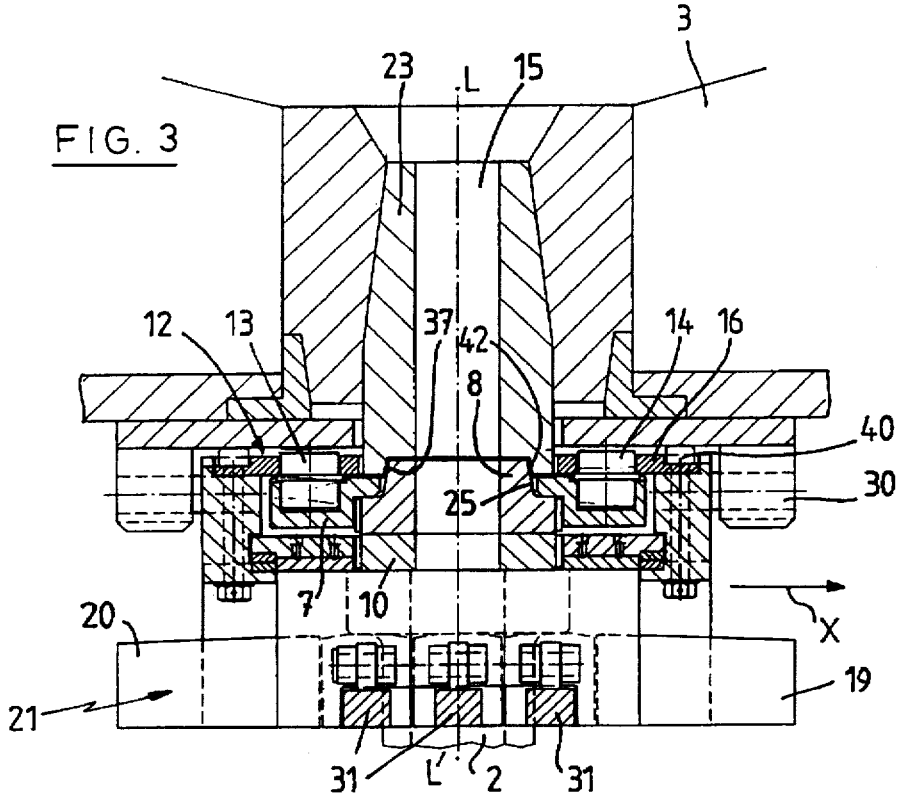
FIG. 3 is a transverse section along the line III—III of FIG. 2 of the device illustrated in FIGS. 1 and 2.
Figure 4:
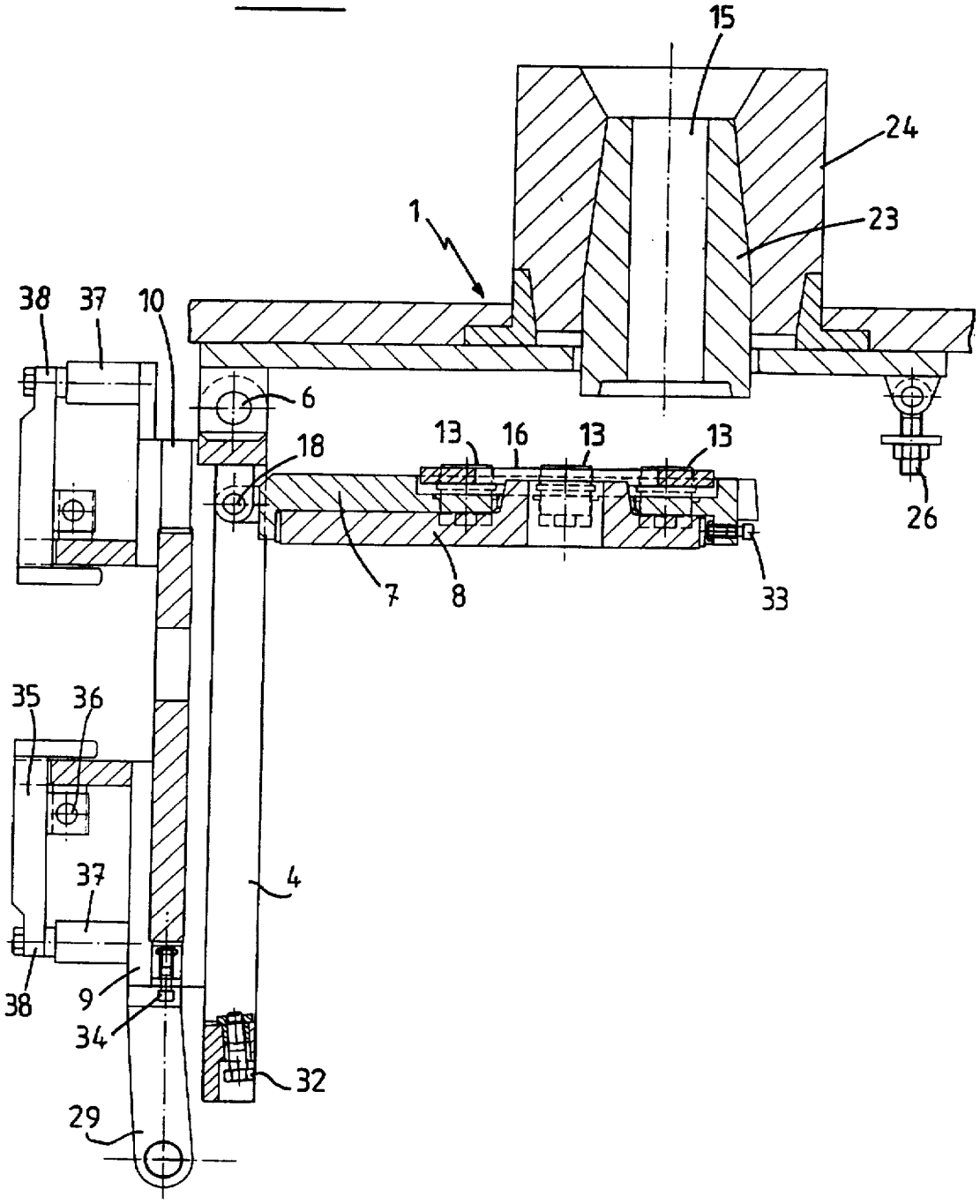
FIG. 4 is a longitudinal section similar to that of FIG. 1 of the device for bringing and exchanging a pouring tube and for controlling the rate, in the open position.

As illustrated in FIG. 1, a sliding closure device 1 which brings and exchanges a pouring tube 2 and controls the flow rate of a pouring ladle 3 comprises a rectangular metal chassis 4 arranged so as to be able to pivot with respect to a bottom wall 5 of the pouring ladle 3 about one of its sides means of first horizontal pivots 6 arranged transversely with respect to the direction of movement of the movable plate 10 for the purpose of controlling the pour rate. The first pivots 6 are engaged in lugs 30 fixed to the bottom of the pouring ladle 3.

The metal chassis 4 supports a push-cover 7 containing a stationary upper plate 8 and a carriage 9 carrying the movable plate 10.

The upper plate 8 is pushed downwards by a pressing device 12 made up of two series of spring cartridges 13, 14 arranged on each side of the tap hole 15 along opposite sides of the stationary upper plate 8. The spring cartridges 13, 14 are kept in place by the studs 17. They are subjected to a compressive pre-stress, before the chassis 4 is raised and locked.

The movable plate 10 is subjected to a downwards thrust transmitted by the stationary upper plate 8 pushed back downwards by a series of spring cartridges 13, 14 and it is also subjected to an upwards thrust exerted by the pouring tube, subjected to the action of the pushing devices 31, which act independently of the cartridges 13, 14. The movable plate 10 is therefore compressed between the stationary upper plate 8 and a flange 11 of the pouring tube 2.

The push-cover 7, arranged so as to pivot downwards about second horizontal pivots 18 is hinged to the metal chassis 4.

The carriage 9 comprises means 19, 20 for guiding the pouring tube 2 which is stood up vertically. The guide means 19, 20 extend in a horizontal plane. They bring the replacement pouring tube 2 from a loading position 21 located away from the tap hole to a standby position 22 located just beneath the pouring orifice 27 of the movable plate 10 at the instant at which the latter is in the position for blocking the tap hole. The pushing means 31 are pushed back upwards by levers 35 which are hinged at 36 and subjected to the action of springs 37 at their free end 38.

In FIG. 1, the first and second pivots 6, 18 are mutually parallel. They define a rotation axis LL' perpendicular to the direction of movement in the direction of the arrow X of the two-plate slide valve formed by the stationary upper plate 8 and the movable plate 10 as the steel flow rate is controlled.

The doubly hinged chassis 4 quite simply facilitates access to the refractory components, particularly to the movable plate 10.

The assembly and dismantling of the hinged chassis 4 of a device for bringing and exchanging a pouring tube 2 and for controlling a pouring ladle 3 on the bottom wall 5 of a pouring ladle 3 takes place as follows.

For assembly, an internal nozzle 23 is positioned in a nozzle seating block 24 of the pouring ladle 3 from below. A seal 25 is arranged on the protruding lower flange of the internal nozzle 23 and the seal 25 is coated with a refractory mastic 42 before interlocking a frustoconical tab of an upper plate 8 into the lower end of the internal nozzle 23.

Two series 13, 14 of spring cartridges are kept in place with the aid of a compression plate 16 fixed removably to the upper plate 8 with the aid of studs 17. In order to fix the compression plate 16 to the push-cover 7, spring cartridges 13, 14 are compressed with the aid of hydraulic tooling, not shown, by pushing on the compression plate 16, and the compression plate 16 is locked with the aid of anchoring pieces including a wing nut 40. By releasing the hydraulic tooling, the upper plate is freed.

The machine is closed, by folding the push-cover 7 over the metal chassis 4 in the clockwise direction and by folding the metal chassis 4 in the anticlockwise direction against the bottom wall 5 of the pouring ladle 3. This locking of the metal chassis 4 takes place by tilting eyelet screws 26 into a notch 41 of the metal chassis 4. The hydraulic actuator is fixed to the movable carriage by a stud inserted into the hole 28 made in the anchoring tab 29 of the carriage 9.

The dismantling of the device for bringing and exchanging a pouring tube and for controlling the flow rate takes place in the reverse order to the assembly:

- tilting the eyelet screws 26 fixing the rectangular metal chassis 4 to the bottom wall 5 of the pouring ladle 3;
- opening the machine out into the vertical position;
- compressing the spring cartridges with the aid of hydraulic tooling, not shown, bearing on the compression plate 16;
- unblocking the wing nuts 40 fixing the push-cover 7 to the rectangular metal chassis 4;
- loosening the screws 32;
- opening the push-cover 7;
- loosening the screws 33, 34 for locking the stationary upper plate 8 and removable plate 10;
- dismantling the stationary upper plate 8 and the movable plate 10.

I claim:

1. A device for controlling a pour rate comprising a rectangular metal chassis arranged so as to be able to pivot with respect to a bottom wall of a pouring ladle and a push-cover containing a stationary upper plate and means comprising a movable carriage carrying a movable plate which is arranged between the stationary upper plate and a flange of a pouring tube which is applied against the movable plate in tight contact with the stationary upper plate, the movable and stationary plates being pressed against one another by means of a device for pressing the stationary upper plate against the movable plate, the movable plate and said pouring tube provided with the movable plate being slideably movable in a horizontal plane and in a vertical position from a loading position blocking a tap hole to a standby position beneath a pouring orifice of the movable plate and from the standby position to a position for unloading the pouring tube by pushing by means of an actuator, and wherein said device comprises means of pressure tapping which consist of first and second pushing means, the first pushing means being means for pushing downward to apply the stationary upper plate against a reference plane formed by the movable plate in the blocking position of the tap hole and the second means being a means for pushing upward to apply the pouring tube against the pouring orifice of the movable plate in the position for blocking the tap hole.

2. A device according to claim 1, wherein the push-cover is hinged onto the metal chassis around second pivots.

3. A device according to claim 1 or 2, wherein the device for pressing the stationary upper plate against the movable plate consists of two series of spring cartridges arranged on either side of the tap hole along opposite sides of the stationary upper plate.

4. A device according to claim 3, wherein the spring cartridges are kept in place by a compression plate fixed removably to the push-cover with the aid of studs.

5. A device according to claim 2, wherein the device for pressing the stationary upper plate against the movable plate further includes first pivots parallel to the second pivots.

6. A device according to claim 1 or 2 wherein the movable carriage moves the movable plate from a position for blocking the tap hole into a position for opening the tap hole, so as to control the pour rate, and wherein the movable carriage moves, together with the movable plate, a device for bringing and loading the pouring tube.

7. A device according to claim 1 wherein guide means carried by the movable carriage are perpendicular to the direction of movement of the carriage during control of the pour rate.

8. A device according to claim 1 wherein the movable carriage moves along a guide path which is perpendicular to first pivots.

9. A device according to claim 2, wherein the device for pressing the stationary upper plate against the movable plate consists of two series of spring cartridges arranged on either side of the tap hole along opposite sides of the stationary upper plate.

10. A device according to claim 3 wherein the movable carriage moves the movable plate from a position for blocking the tap hole into a position for opening the tap hole, so as to control the pour rate, and wherein the movable carriage moves, together with the movable plate, a device for bringing and loading the pouring tube.

* * * * *